US005558586A

United States Patent [19]

Izett et al.

[11] Patent Number: 5,558,586

[45] Date of Patent: *Sep. 24, 1996

[54] GOLF PUTTER HEAD AND CLUB

[76] Inventors: George G. Izett, 165 Cassatt Rd., Berwyn, Pa. 19312; Jay Ciccarone, 668 Woodland Ave., Pottstown, Pa. 19464

[ * ] Notice: The term of this patent shall not extend beyond the expiration date of Pat. No. 5,547,196.

[21] Appl. No.: 524,124

[22] Filed: Aug. 28, 1995

Related U.S. Application Data

[63] Continuation of Ser. No. 313,732, Sep. 27, 1994, abandoned.

[51] Int. Cl.[6] ..... A63B 53/14

[52] U.S. Cl. ..... 473/251; 473/294; 473/313

[58] Field of Search ..... 273/81.3, 167 B, 273/80 C, 81 R, 194 R; 473/251–255, 294

[56] References Cited

U.S. PATENT DOCUMENTS

| | | | |
|---|---|---|---|
| 792,631 | 6/1905 | Taylor . | |
| 1,919,221 | 10/1931 | Janes . | |
| 2,204,974 | 9/1938 | Strasser . | |
| 3,529,826 | 8/1967 | Hulyk . | |
| 4,140,318 | 2/1979 | Izett et al. . | |
| 4,215,860 | 8/1980 | Nakamatsu | 273/81 R |
| 4,754,978 | 7/1988 | Dworacek | 273/194 R |
| 5,037,103 | 8/1991 | Williams et al. | 273/80 C |
| 5,209,475 | 5/1993 | Loman | 273/194 R |
| 5,308,073 | 5/1994 | McKoon et al. | 273/81 R |

FOREIGN PATENT DOCUMENTS

| | | | |
|---|---|---|---|
| 238646 | 10/1960 | Australia | 273/80 C |
| 52-23431 | 2/1977 | Japan . | |

*Primary Examiner*—Mark S. Graham

*Attorney, Agent, or Firm*—Reed Smith Shaw & McClay

[57] ABSTRACT

A golf putter head and a golf club are provided. Using two conventional shafts and connecting them in two hosels of the golf putter head, the golfer may position his or her hands at a distance apart and thus create a natural pendulum motion from the shoulder. The position of the hands may be varied to accommodate a range of golfers with different physiques by the application of force to the grips, moving them toward or away from each other. In addition, or in the alternative, the distance between the hands may be decreased by such force as the golfer becomes more comfortable with the feel of the shoulder stroke to more closely simulate the use of a conventional putter club. The present invention also includes a method of teaching a desirable and repeatable putting form and stroke.

10 Claims, 5 Drawing Sheets

GOLF PUTTER HEAD AND CLUB

This application is a continuation of application Ser. No. 08/313,732, filed on Sep. 27, 1994, now abandoned.

FIELD OF THE INVENTION

In general, this invention relates to a putter used in the game of golf and, more specifically, to a golf putter head, and a putter club comprising such a head, which may be used to train and to assist a golfer in the development and maintenance of a desirable and repeatable putting form and stroke.

BACKGROUND OF THE INVENTION

The ability to putt a golf ball with consistent accuracy flows from the use of the proper form in the golfer's putting stroke. It is preferable, if not essential, for golfers to learn to stroke the golf club by the use of, primarily, their shoulders. Excessive use of the golfer's wrists in the stroke, in many instances, causes the club head to approach and come into contact with the golf ball in a manner which results in pushing, pulling and other undesirable movement or paths as the club head approaches the ball, at impact, and as the golfer follows through. It is desirable for beginning golfers to learn to use a putting stroke primarily driven by the shoulders in a pendulum motion. For intermediate and advanced golfers, it is desirable to continue to practice and maintain a proper shoulder driven stroke.

Although some prior art devices developed to date appear to assist in the development and maintenance of a proper putting stroke, many shortcomings still exist. For instance, many of the prior art putting clubs are made with specialized club shafts. Such shafts tend to add to the overall cost of the club by, for instance, adding to the difficulty and cost of manufacturing it. This cost is increased when the club incorporates two specialized shafts.

In addition, since such clubs are typically designed to be used by a golfer of a specific size and height, the same club may not be comfortably used by a different golfer. When training and trying to develop an acceptable level of consistency in his or her putting stroke, and in order to maintain the proper stroke, the golfer preferably uses a club sized and configured for the most comfort and the most desirable feel. The club of choice is usually sized for golfers of a certain physique (i.e., configured to be most comfortably used by a golfer with a particular shoulder breadth, arm length and height). Since the typical club is not adjustable, however, clubs of a number of different sizes and configurations must be made to meet the needs of golfers with different physiques.

Different sizes and configurations of a training putter club may also be desired by an individual golfer for his or her own use. A change in the desired size or configuration typically requires the golfer to use a different club because the typical training putter club has no means of adjustment. For instance, when a golfer has been practicing his or her "shoulder stroke" with a two shaft training putter club with hand grips 12" apart desires to move from that configuration to a practice with hand grips 6" apart (i.e., in an effort to gradually move to a one shaft putter club after learning and maintaining the proper "shoulder stroke"), a typical problem arises. There is typically no means of reducing, for example, the space between the hand grips from 12" to 6". Even if there is a similar club available with 6" spacing, along with the additional club comes the additional cost of using more than one club to achieve the desired feel of gradually decreasing the space between the golfer's hand grips.

One possible means of decreasing production and related costs is to, where possible, use conventional golf club components (e.g., the mere use of conventional shafts with special putter heads would minimize the production costs). If the club head was the only specialized component, in addition to reducing production costs, the specialized head could be made available to golf club suppliers and golfers who wish to reduce their overall cost by purchasing only specialized heads and connecting them to components to which they have ready access. Many of the prior art clubs, however, require the use of specialized components for the club shafts, head and other elements.

OBJECTS OF THE INVENTION

It is therefore an object of the present invention to provide golfers and teaching professionals with a training putter which assists in the teaching, development and maintenance of a desirable and repeatable putting stroke.

Another object of the present invention is to provide a golf putter club head that allows a club to which it is attached to be used by a variety of golfers with differing comfort configurations.

Yet another object of the present invention is to provide a golf putter club head, which when connected to two shafts, allows for adjustment of the space between the hand grips at the end of shafts.

An additional object of the present invention is to provide a golf putter club head that may be used with conventional golf club shafts.

Still another aspect of the present invention is to provide a golf putter club that is relatively inexpensive to manufacture and is adjustable to meet the comfort needs of golfers with different physiques and skill levels.

The foregoing specific objects and advantages of the invention are illustrative of those which can be achieved by the present invention and are not intended to be exhaustive or limiting of the possible advantages which can be realized. Thus, these and other objects and advantages of the invention will be apparent from the description herein or can be learned from practicing the invention, both as embodied herein or as modified in view of any variations which may be apparent to those skilled in the art. Accordingly, the present invention resides in the novel parts, constructions, arrangements, combinations and improvements herein shown and described.

SUMMARY OF THE INVENTION

The present invention, in general, is a golf club putter head comprising a body with a first and a second hosel extending from its top, a heel, and a ball striking face. Both the first and second hosels preferably have proximate ends, where they are attached to the top of the body, have opposing distal ends, and are sized and configured to accept, preferably, a conventional golf club shaft, one in each hosel. As attached to the body of the golf club head, the first and second hosels are preferable positioned such that the angle between them causes the shafts connected thereto to be positioned at a desired angle relative to each other. That is, the first and second shafts, when connected to a head in accordance with the present invention, would extend from the head at a predetermined angle in an imaginary plane. The imaginary plane would include the grips of the two shafts and a point on the head. With no external forces acting on the grips, they are in a first position and the shafts are at an angle which tends to compel the golfer to stroke with the shoulders, in a pendulum motion, instead of swinging at the wrists.

In further embodiments of the present invention, the angle between the first and second hosels is situated in an imaginary plane perpendicular to the ball striking face. In other preferred embodiments, (1) the shafts are conventional, straight golf club shafts, (2) the angle between the shafts is in the range from 5° to 30°, and is preferably 14°, and (3) the golfer, by applying a force to the grips may move the grips from a first position to a second position, for instance, to a second position where the shafts are substantially parallel to each other, while the first and second hosels hold the connecting ends the shafts in a fixed position.

In still another embodiment, the present invention is a putter golf club comprising, primarily, a head and two shafts. In this particular embodiment, the head includes a body having a ball striking face and, extending from the top of the head, two hosels. One of the two shafts is connected to one hosel and the second shaft is connected to the second hosel. In this embodiment, the shafts are positioned at a desired angle relative to each other such that the grips of the shafts are a desired distance apart relative to each other. The desired angle and distance may be varied by applying a force on the grips, moving them together or apart. Here, the club is preferably made from conventional, straight golf club shafts. The desired angle, when the shafts are substantially straight and free of external forces acting on them, is in the range from 5° to 30°, and is preferably 14°.

The present invention also includes a method of teaching a desirable and repeatable putting form and stroke. This method includes the steps of (a) grasping, one in each hand, the grips of a putter club with two shafts, (b) applying a force, as desired, to the grips to position the golfer's hand, with respect to each other, for a desired comfort and feel, and (c) while in the desired position, moving the club with primarily the use of the shoulders in a pendulum stroke through a desired golf ball placement location. The golfer's hands are thus positioned a desired distance apart to facilitate a stroke driven by the shoulders, as opposed to one which may include excessive use of the golfer's wrists.

In some instances, no force is needed to place the grips in a desired position for the golfer's hands. When a force is needed, however, the amount of that force may vary and depends on, among other things, the physique of the golfer, the position of the grips relative to each other without a force applied on them and the position of the golfer's hands for the desired comfort and feel.

BRIEF DESCRIPTION OF THE DRAWINGS

There are seen in the drawings forms of the present invention which are preferred and which represent the best mode presently contemplated for carrying out the invention. It should be understood, however, that the invention is not limited to the precise arrangements and instrumentalities shown.

DETAILED DESCRIPTION OF THE PREFERRED EMBODIMENTS

Figure 1:
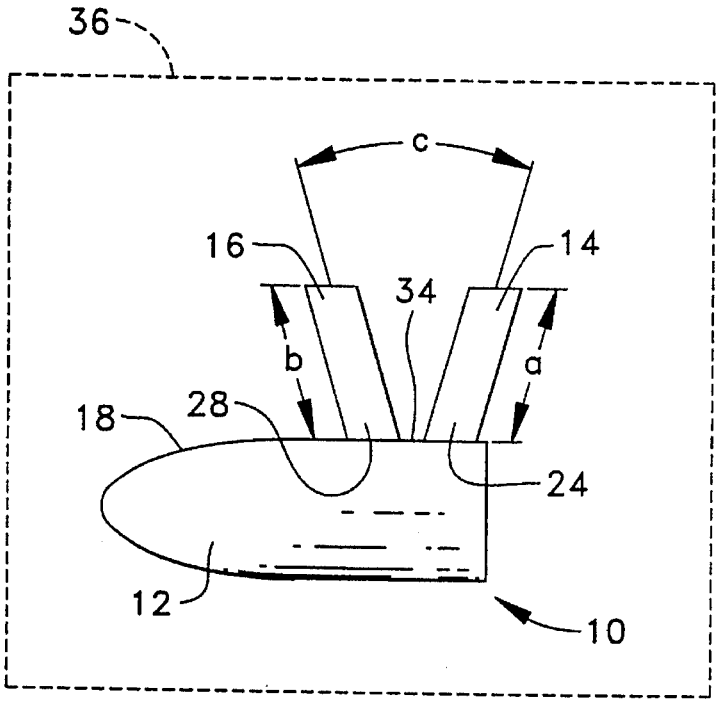
FIG. 1 is a front view of one embodiment of a putter head in accordance with the present invention.
Figure 2:
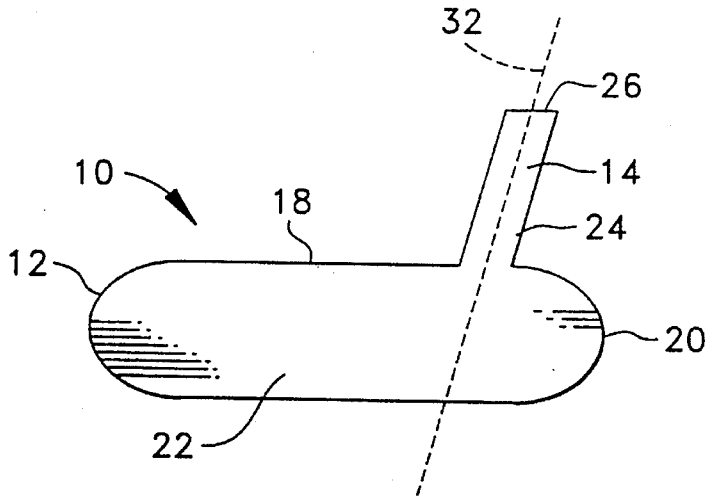
FIG. 2 is side view of the embodiment in FIG. 1.
Figure 3:
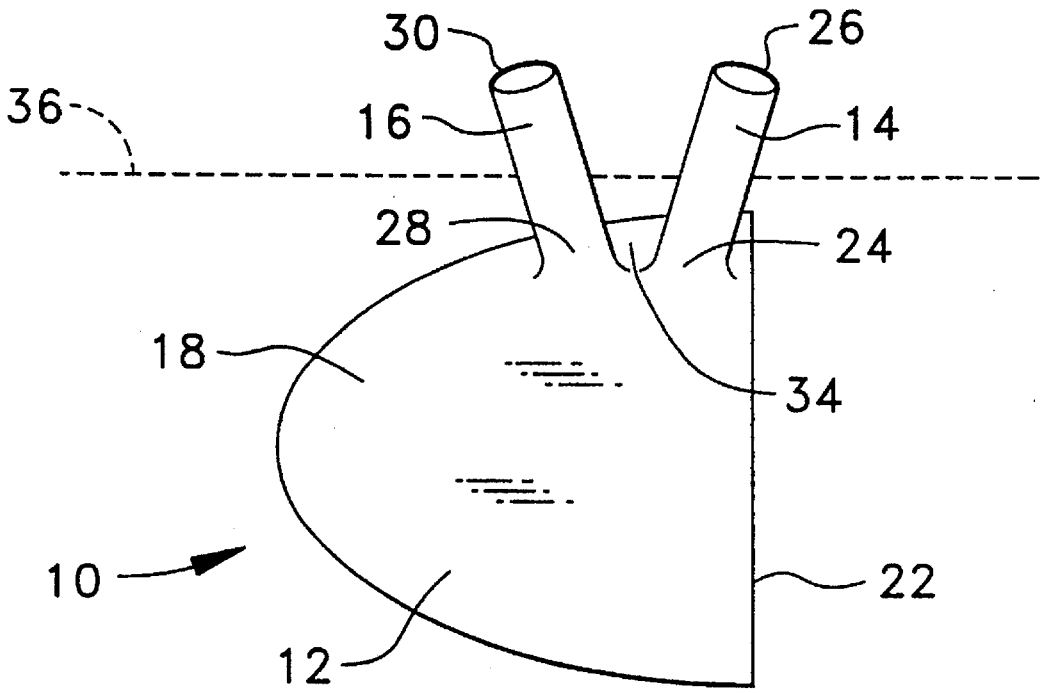
FIG. 3 is a top view of the embodiment in FIGS. 1 and 2.

Referring now to the drawings, there is shown in FIGS. 1, 2 and 3, golf club putter head 10 in accordance with the present invention, comprising body 12, with first hosel 14 and second hosel 16 extending from top 18. Head 10 also comprises heel 20 and a ball striking face 22. One skilled in the art would realize that the possible dimensions and configurations of head 10, i.e., its design and structure, may be varied in various ways without deviation from the present invention. For instance, ball striking face 22 may be on one of two sides of the body 12, depending primarily upon whether the club to which head 10 will be attached will be used by a left-handed or right-handed golfer. Likewise, the material(s) from which head 10 may be constructed could be any material which may be used to construct conventional putter heads. For example, head 10 may be made of such materials as, but not limited to, brass, graphite, copper, aluminum, steel, stainless steel, ceramic, combinations of the foregoing materials, and any similar material. Moreover, body 12, first hosel 14 and second hosel 16, individually, may be made of any one of the same materials or any desirable combination thereof. Head 10, as such, may be formed as a single unit, for instance, from a mold, or may be made, as desired, by the assembly of independently formed components.

In a preferred embodiment of the present invention, first hosel 14 preferably includes proximate end 24, at the point where first hosel 14 is attached to top 18, and distal end 26. Likewise, second hosel 16 includes proximate end 28 and distal end 30. The length "a" between proximate end 24 and distal end 26, and length "b" between proximate end 28 and distal end 30, may be varied as desired and need not be equal. In the preferred embodiment, however, "a" and "b" are both preferably up to 5" long or at any length necessary for the head to function as intended. The size and configuration of first hosel 14 and second hosel 16 are also variable but are preferably formed to function in the same manner as conventional hosels to which shafts are connected to conventional heads. More specifically, first hosel 14 and second hosel 16 are both sized and configured to accept a conventional golf club shaft. One skilled in the art would realize, however, the first hosel 14, second hosel 16, or both may be made of a size and configuration to accept unconventional shafts and/or other elements.

As attached to the body of the golf club head, first hosel 14 and second hosel 16 are preferably positioned relative to each other at angle "c". In the preferred embodiment, angle "c" is selected such that the configuration of first hosel 14 and second hosel 16, along with angle "c", cause the shafts connected thereto to be positioned, in imaginary plane 32 including at least three points (i.e., the grips of the two shafts and, for example, point 34 on body 12 and midway between proximate ends 24 and 28), at a desired angle relative to each other. For instance, in the embodiment shown FIGS. 1, 2 and 3, where angle "c" is 14°, the desired angle between the straight shafts connected to and extending from first hosel 14 and second hosel 16 would be 14°. Angle "c" could be varied to, at a minimum, fix the desired angle between the shafts within a range from 5° to 30°, given the position and configuration of first hosel 14 and second hosel 16, and need not be equivalent to the desired angle.

It is the desired angle between the shafts, and their length, which determine the distance between the grips. The distance, i.e., the spacing between the hands of the golfer during the stroke of the club, may be fixed such that the golfer tends, in the act of stroking a putt, to move primarily at the shoulders instead of at the wrist. The larger the angle, the farther apart the grips are positioned relative to each other and the less inclined the golfer would be to swing his or her club at the wrists.

In the preferred embodiment, angle "c" in imaginary plane 36 which is perpendicular to ball striking face 22. The relationship between imaginary plane 36 and ball striking face 22 may vary, however, depending, for instance, on the desired construction of head 10. For example, if the shafts connected to head 10 are curved in any manner, for the grips to be positioned in the desired location for the golfer, the position of first hosel 14 and second hosel 16 on top 18, and thus the relationship between imaginary plane 36 and ball striking face 22, may be altered. Thus, unconventional or specialized (e.g., curved) shafts may be used in conjunction with present invention, as well as conventional, straight golf club shafts.

Figure 4:
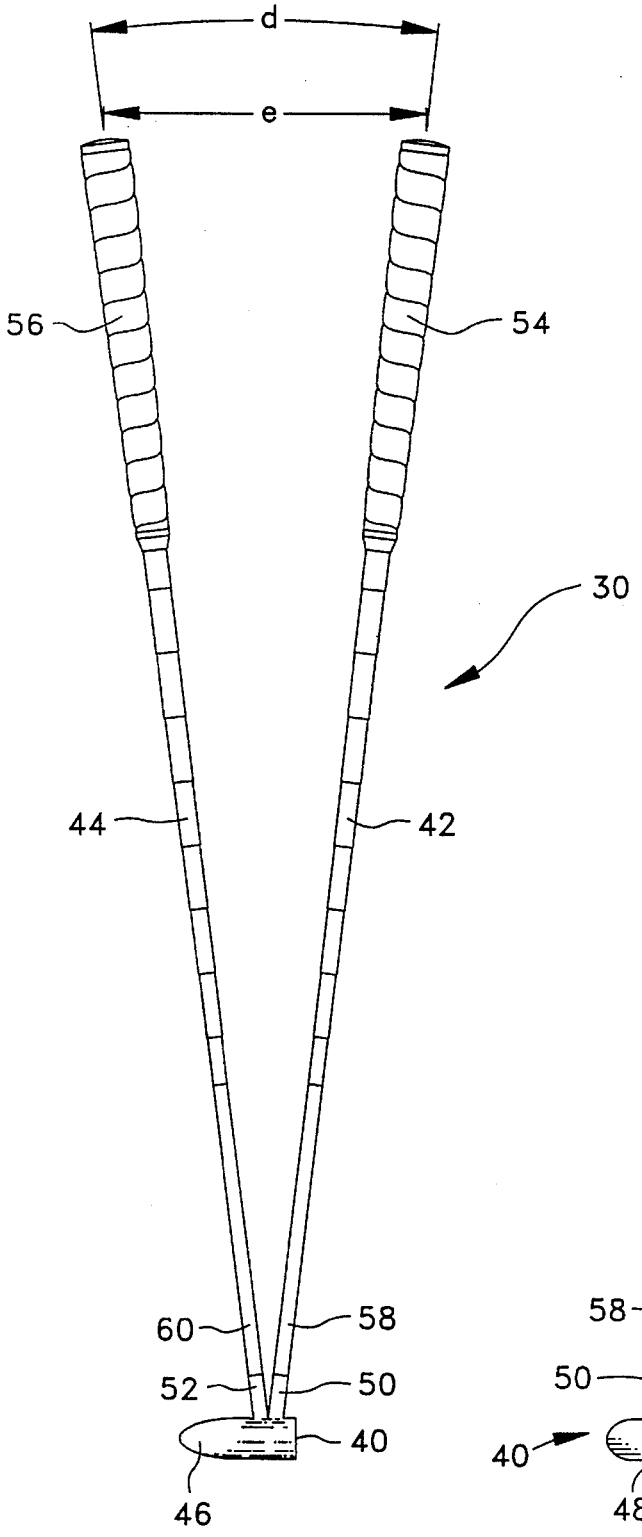
FIG. 4 is a front view of a golf club, in accordance with the present invention, including a putter head with two shafts.
Figure 5:
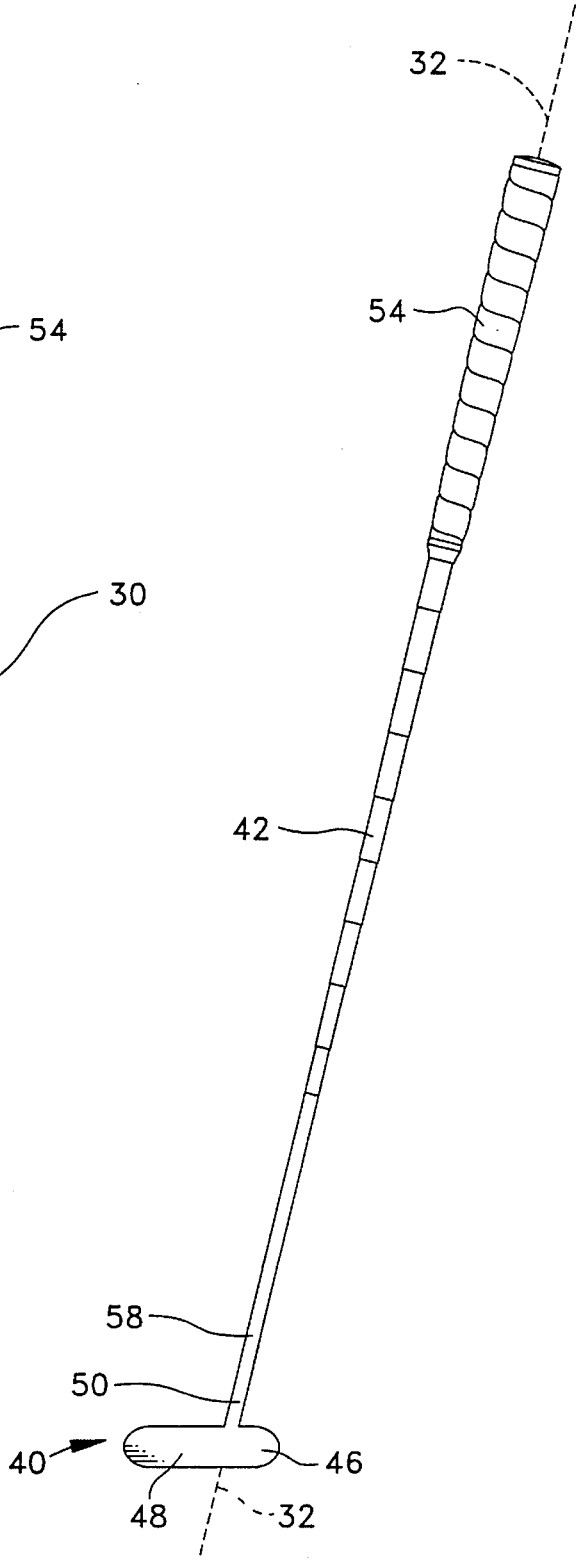
FIG. 5 is a side view of the embodiment in FIG. 4.

As seen in FIGS. 4 and 5, another embodiment of the present invention is putter golf club 38 which primarily comprises head 40 and shafts 42 and 44, preferably conventional, straight golf club shafts. In this particular embodiment, head 40 includes body 46 with ball striking face 48 and hosels 50 and 52. In this particular embodiment, shafts 42 and 44 are positioned at angle "d" relative to each other such that grips 54 and 56 are a desired distance "e" apart. Angle "d" is preferably in the range of 5° to 30°, but is most preferable 14°, when there is no external force applied on grips 54 and 56 which would tend to move them together or apart. Distance "e" is thus in the range of, for example, 2" to 18" and most preferable 9" when shafts 42 and 44 are approximately in the range of, for example, 34" to 36" long. Angle "d", and thus distance "e", are variable by applying a force on grips 54 and 56.

Further, shafts 42 and 44 may be of different lengths. For example, shaft 44 may be longer, with grip 54 higher than the elevation of grip 56. Some golfers desire, for instance, to have the head of the club come into contact with a golf ball at an angle. Typically, this type of stroke is accomplished by slightly tilting the club such that the head is angled relative to the surface upon which a golf ball rests. The use of this set up or stance in the putting stroke tends to, for instance, make the ball topspin after the head comes into contact with it. The use of shafts with different lengths, i.e., grips of different elevations, with a putter head in accordance with the present invention can be used to simulate such a stroke. That is, it simulates how some golfers, using, for example, a blade type putter, tilt same by moving their hands ahead of the blade prior to initiating the putting stroke with their shoulders. With such a configuration, the golfer using the present invention tends to develop the form and feel for the "tilted" stroke during the withdrawal from and the approach to a desired golf ball location. This movement, using a "tilted" conventional club or a club in accordance with the present invention having two shafts of different lengths, preferably does not result in undesirable contact between the base of the club and the surface upon which the ball rests. Obviously, the golfer could practice his or her stroke without actually hitting a ball.

Other variations of the length of shafts 42 and 44 can be made to accommodate different teaching and/or practice objectives, and the like, as are known in the art. For example, one known putting stroke requires, in the right-handed golfer, for the right shoulder to be positioned slightly lower than the left shoulder throughout the putting stroke. Simulation of this type of putting stroke can be accomplished and/or emphasized, for example, by having shaft 42 longer than shaft 44, whereby when the golfer grips shafts 42 and 44, his or her left shoulder is automatically positioned higher than the right shoulder (the forward shaft would be in the left hand). Obviously, one would reverse the foregoing if the club is to be used by a left-handed golfer (the forward shaft in the right hand).

The position of shaft 42 is also relative to an imaginary plane parallel to the surface of ball striking face 48. For instance, grip 54 of shaft 42 may, with no force applied to it, sit in a position where grip 54 is on the forward side of the imaginary plane, opposite and forward head 40. In other words, as ball striking face 48 of golf club 38 comes into contact with a golf ball, grip 54 is positioned, in a vertical plane, closer to the golf hole than ball striking face 48. In fact, in the preferred embodiment, with a golfer holding club 38 in the normal impact position, and no substantial external forces acting on grip 48, grip 48 would be in a position substantially over the ball. Shaft 44 may be likewise positioned in the opposite direction with grip 56 being the point on club 48 the farthest behind and away from the ball and such that grip 56 is in a position in a vertical plane behind head 40.

Figure 6:
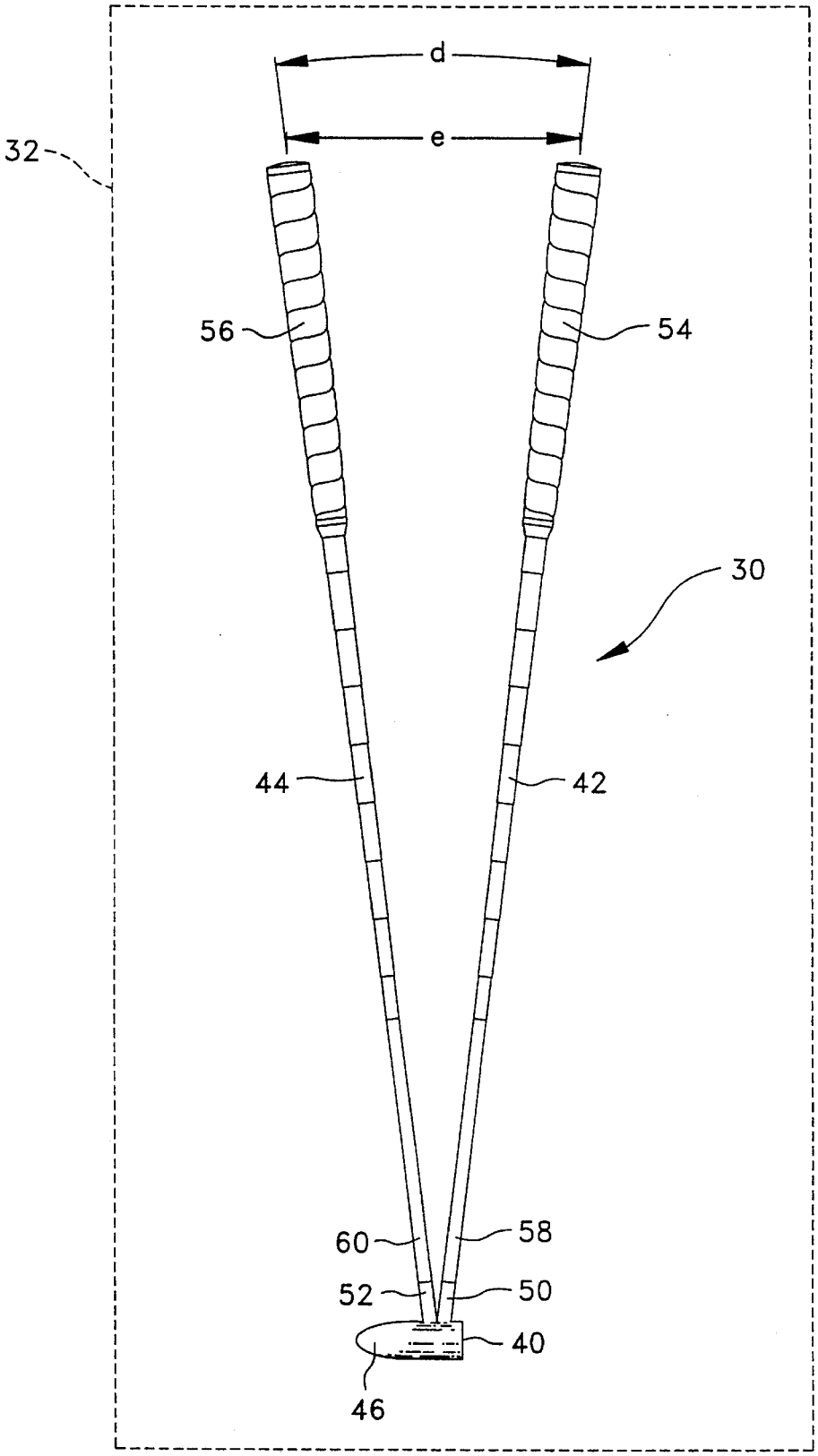
FIG. 6 is a front view of the embodiment in FIG. 4 with a force applied thereon.

The flexibility of shafts 42 and 44 adds to overall usefulness of the present invention. For instance, as seen by way of example in FIG. 6, when shafts 42 and 44 have the requisite amount of flexibility (e.g., the amount of flexibility found in regular rather than stiff golf club shafts), the golfer may, by moving the grips from a first position (i.e., when there is no substantial external force being placed on the grips in imaginary plane 32) to a second position, while hosels 50 and 52 hold connecting ends 58 and 60 in a relatively fixed position. In the second position, shafts 42 and 44 may be substantially parallel to each other. The requisite amount of flexibility can vary to accommodate the comfort level individual golfers and in a manner to effectuate the desired teaching/practice effect. For example, flexibility of shafts 42 and 44 in most cases should be stiff enough to hold the hands (at the requisite distance from each other) to encourage a putting stroke whose movement is driven by the pendulum motion at the shoulders, free of any movement of the arms and wrists. Further, shafts 42 and 44 are preferably flexible enough to allow the golfer to practice the putting stroke with two shafts virtually parallel to simulate the putting stroke with a regulation/single shafted putter without requiring undue force or tension to develop in the arms or hands to accomplish this end.

This flexibility allows the golfer to decrease the distance between his or her hands as the stroke improves. Starting at a predetermined angle (e.g. 14°), the golfer may, at his or her own pace (i.e., as the golfer becomes comfortable with the feel of a proper "shoulder stroke" with his or her hands at the predetermined angle), decrease the angle (i.e. toward 0° with shafts 42 and 44 substantially parallel and a minimum distance between the golfer's hands). With the ability to position the golfer's hands closer together as the golfer's "shoulder stroke" improves, the golfer can learn and maintain a proper stroke for use with a conventional putter club.

Figure 7:
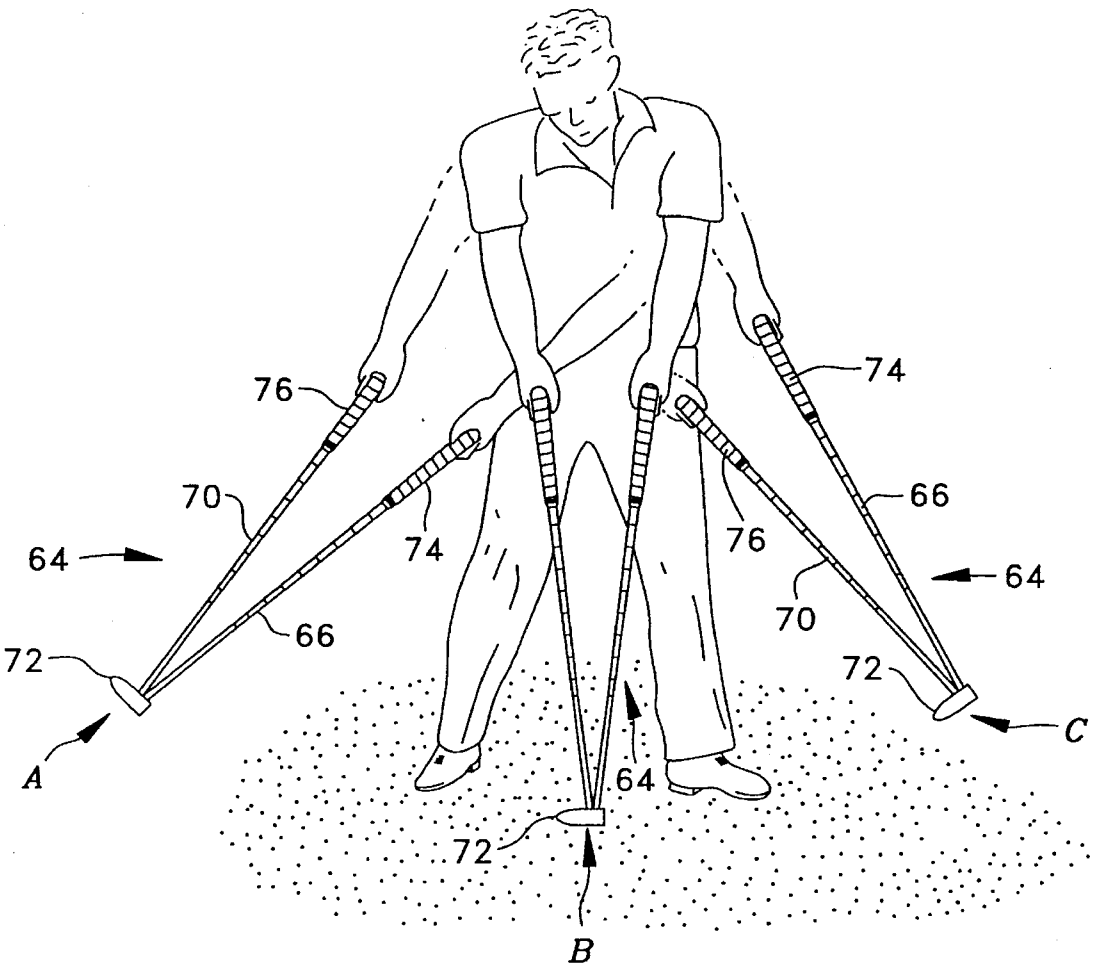
FIG. 7 is a schematic view of a golfer at three stages of a stroking motion using a golf club in accordance with the present invention.

FIG. 7 shows golfer 62 in three stages of a putting stroke using an embodiment of the present invention. At stage "A", golfer 62 holds club 64 at the apex of a back stroke. Of course, the arc of the back stroke will depend on such factors as, for example, the distance ball 66 rest from the hole (not shown in this view), the flexibility in shafts 68 and 70, the structure and materials used for head 72. At stage "B", club 64 comes in contact with ball 66. Stage "C" shows an example of a position of golfer 62 and club 64 at the apex of a follow through of the stroke. In this particular embodiment, shafts 68 and 70 are at an angle "f", preferably 14°, however, this angle may be varied by golfer 62 by applying a desired amount of force upon grips 74 and 76. Typically, angle "f", with golfer 62 holding grips 74 and 76 a comfortable distance apart, will depend upon the physique of golfer 62 (i.e., such factors as, for example, height, hip weight, shoulder height, shoulder width and other determining features) and the desired position of the hands of golfer 62. By keeping grips 74 and 76 in line with the shoulders of golfer 62, the arms will tend to swing from the shoulders without the wrists being unnecessarily involved in the stroking action. The stroking path therefore is more accurate because of the natural pendulum motion (i.e., stage "A" through stage "C").

The present invention also includes a method of teaching a desirable and repeatable putting form and stroke, practiced to develop and maintain the golfer's stroke, wherein the golfer's hands are positioned a desired distance apart to facilitate a stroke driven by the shoulders, as opposed to one which may include excessive use of the golfer's wrists. The method includes the step of grasping, one in each hand, the grips of a putter club with two shafts. The position of the grips during the use of the club should provide the desired comfort and feel.

If the grips are not in a comfortable position for the golfer, he or she may move them to a desired position by applying a force to the grips and thereby move them closer together or further apart. No force would be needed, for instance, if the grips were already in a desired position. The force applied, if any, may depend on such factors as, but not limited to, the physique of the golfer, the position of the grips relative to each other without a force applied on them and the position of the golfer's hands for the desired comfort and feel.

While in the desired position, the golfer may move the club, with primarily the use of the shoulders, in a pendulum stroke through a desired golf ball placement location. By this movement, with hands apart, the golfer learns and develops the feel of a proper stroke.

The above embodiments are merely illustrations of the apparatus claimed herein. The invention also includes other embodiments not specifically disclosed above, embodiments which one skilled in the art would realize and envision as equivalents or derivations of the embodiments shown and existing in other specific forms without departing from its spirit or essential attribution. Numerous variations may be made within the scope of this invention without departing from the principle of the invention and without sacrificing its chief advantages. Thus, the terms and expressions have been used as terms of description and not terms of limitation. Instead, reference should be made to the appended claims, rather than to the foregoing specification and drawings, as indicating the scope of the apparatus invention.

What is claimed is:

1. A putter golf club for training a golfer to repeatedly putt using a constant putting stroke, said golfer having a pair of shoulders, first and second hands, first and second arms, and first and second wrists, said first wrist connecting said first arm and said first hand at a first wrist angle, said second wrist connecting said second arm and said second hand at a second wrist angle, said constant putting stroke being defined by movement of said shoulders of said golfer in a pendulum motion and an absence of angular movement in said first and second wrist angles during said pendulum motion, comprising:

a head having a body with a heel, a top and a ball striking face, said ball striking face being formed of a flat surface lying in a first plane;

a first hosel with a first proximate end attached to the top of the head and an opposing first distal end rigidly connected to a first end of a first flexible shaft;

a second hosel with a second proximate end attached to the top of the head and an opposing second distal end rigidly connected to a first end of a second flexible shaft, said first and second flexible shafts lying in a second plane that is perpendicular to said first plane;

said first and second hosels being substantially positioned at a first angle relative to each other such that the first and second flexible shafts extend therefrom with a desired second angle between the first and the second flexible shafts, said desired second angle tending to train said golfer to repeatedly putt using said constant putting stroke when said first and second shafts are simultaneously and respectively gripped by said first and second hands of said golfer;

and wherein said first and second flexible shafts each have a flexibility which is sufficiently rigid to hold said desired second angle fixed so long as said golfer uses said constant putting stroke to swing said putter club, said flexibility being insufficiently rigid to hold said desired second angle fixed when said golfer varies one or both of said first and second wrist angles during movement of said putter golf club.

2. The putter golf club as recited in claim 1 wherein the first and second shafts are conventional, straight golf club shafts.

3. The putter golf club as recited in claim 1 wherein the desired second angle, when the first shaft and the second shaft are substantially straight and free of external forces acting thereon, is in the range of from 5° to 30°.

4. The putter golf club as recited in claim 3 wherein the second angle is of 14°.

5. A putter golf club for training a golfer to repeatedly putt using a constant putting stroke, said golfer having a pair of shoulders and first and second hands, said constant putting stroke being defined by movement of said shoulders of said golfer in a pendulum motion, comprising:

a head with a body including a ball striking face and, extending from the top of the head, a first hosel and a second hosel, said ball striking face being formed of a flat surface lying in a first plane;

a first flexible shaft having first and second ends, said first end of said first flexible shaft having a first grip, said second end of said first flexible shaft being rigidly connected to the first hosel such that said second end of said first flexible shaft is held in a fixed position relative to said head;

a second flexible shaft having first and second ends, said first end of said second flexible shaft having a second grip, said second end of said second flexible shaft being rigidly connected to the second hosel such that said second end of said second flexible shaft is held in a fixed position relative to said head, said first and second flexible shafts lying in a second plane that is perpendicular to said first plane;

said first and second hosels being positioned such that the first and second flexible shafts are positioned at a desired angle and a desired distance apart relative to each other when said first end of said first flexible shaft and said first end of said second flexible shaft are respectively grasped by said first and second hands of said golfer; and wherein said first and second flexible shafts have a flexibility sufficient to allow said golfer to contract the desired angle and distance when said first and second grips are simultaneously and respectively grasped by said first and second hands of said golfer to simulate a single-shafted putter grip by applying a compressive force with said first and second hands on the first and second grips.

6. The club as recited in claim 5 wherein the first and second shafts are conventional, straight golf club shafts.

7. The club as recited in claim 5 wherein the desired angle, when the first shaft and the second shaft are substantially straight and free of external forces acting thereon, is in the range from 5° to 30°.

8. The club as recited in claim 7 wherein the second angle is of 14°.

9. A method for training a golfer to repeatably putt using a constant putting stroke, said golfer having a pair of shoulders, first and second hands, first and second arms, and first and second wrists, said first wrist connecting said first arm and said first hand at a first wrist angle, said second wrist connecting said second arm and said second hand at a second wrist angle, said constant putting stroke being defined by movement of said shoulders of said golfer in a pendulum motion and an absence of movement in said first and second wrist angles during said pendulum motion, comprising the steps of:

simultaneously grasping a first grip of a putter club with said first hand and a second grip of said putter club with said second hand, said putter club having a first flexible shaft with first and second ends, said first end of said first flexible shaft having said first grip, said second end of said first flexible shaft being rigidly connected to a first hosel affixed to a head of said putter club such that said second end of said first flexible shaft is held in a fixed position relative to said head, said putter club having a second flexible shaft with first and second ends, said first end of said second flexible shaft having said second grip, said second end of said second flexible shaft being rigidly connected to a second hosel affixed to said head such that said second end of said second flexible shaft is held in a fixed position relative to said head;

positioning with said first and second hands said first and second grips such that said first and second hands are in a desired position for comfort and feel, said first and second shafts being a desired distance apart and at a desired angle with respect to each other when said first and second grips are positioned in said desired position; and while said desired angle and said desired distance remain fixed, moving said head of said putter club through a desired golf ball placement location with said constant putting stroke;

wherein said first and second flexible shafts have a flexibility which is sufficiently rigid to hold said desired angle and said desired distance fixed during said moving step so long as said golfer uses said constant putting stroke during said moving step, said flexibility being insufficiently rigid to hold said desired angle and said desired distance fixed when said golfer varies one or both of said first and second wrist angles during movement of said putter club; wherein said putter club has a ball striking face formed of a flat surface lying in a first plane, said first and second shafts lying in a second plane perpendicular to said first plane.

10. The method recited in claim 9 wherein said positioning step further includes applying a compressive force to said first and second grips with said first and second hands so as to contract said desired angle and said desired distance prior to said moving step;

whereby said first and second hands are positioned so as to simultate a single-shafted putter grip prior to said moving step.

* * * * *